US008434850B2

(12) United States Patent
Ibe et al.

(10) Patent No.: US 8,434,850 B2
(45) Date of Patent: May 7, 2013

(54) LIQUID DISCHARGE HEAD AND MANUFACTURING METHOD OF THE SAME

(75) Inventors: Satoshi Ibe, Yokohama (JP); Hiroto Komiyama, Tokyo (JP); Toshiaki Kurosu, Kawasaki (JP); Kouji Hasegawa, Kawasaki (JP); Koji Sasaki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/233,875

(22) Filed: Sep. 15, 2011

(65) Prior Publication Data

US 2012/0075386 A1 Mar. 29, 2012

(30) Foreign Application Priority Data

Sep. 29, 2010 (JP) ..... 2010-219482

(51) Int. Cl.
*B41J 29/377* (2006.01)
*B41J 2/05* (2006.01)

(52) U.S. Cl.
USPC ..... 347/18; 347/62; 347/63

(58) Field of Classification Search ..... None
See application file for complete search history.

(56) References Cited

U.S. PATENT DOCUMENTS 6,065,823 A * 5/2000 Kawamura ..... 347/18

FOREIGN PATENT DOCUMENTS

JP 2002-11882 A 1/2002
JP 2005-280179 A 10/2005

* cited by examiner

*Primary Examiner* — Geoffrey Mruk
(74) *Attorney, Agent, or Firm* — Canon USA Inc IP Division

(57) ABSTRACT

A liquid discharge head having a liquid discharge head substrate including an element row in which a plurality of energy generating elements for generating thermal energy for use in discharging liquid are arranged, and a discharge port member corresponding to each of the plurality of energy generating elements, the discharge port members including a plurality of walls in contact with the liquid discharge head substrate to form a plurality of liquid chambers for storing liquid and a plurality of discharge ports which communicate with each of the plurality of the liquid chambers to discharge liquid with the thermal energy generated by the energy generating element. The liquid discharge head further includes a plurality of heat dissipating members corresponding to each of the plurality of the liquid chambers and having a first portion exposed to the liquid chamber and a second portion exposed to the atmosphere.

11 Claims, 12 Drawing Sheets

LIQUID DISCHARGE HEAD AND MANUFACTURING METHOD OF THE SAME

BACKGROUND OF THE INVENTION

1. Field of the Invention

The present invention relates to a liquid discharge head and a manufacturing method of a liquid discharge head.

2. Description of the Related Art

A liquid discharge apparatus represented by an ink jet recording apparatus induces film boiling of ink using thermal energy generated by an energy generating element formed on a liquid discharge head. Then, the liquid discharge apparatus discharges ink to a recording medium using bubble pressure produced by the film boiling of ink to perform recording operation. The liquid discharge head includes a liquid discharge head substrate containing the energy generating elements arranged in row on the surface thereof, and a discharge port member containing a discharge port, joined with the liquid discharge head substrate. The liquid discharge head needs to have heat storage performance to transfer heat generated by the energy generating elements to ink effectively. Japanese Patent Application Laid-Open No. 2005-280179 discusses a liquid discharge head in which a heat storage layer composed of silicon oxide is provided between an energy generating element on the liquid discharge head substrate and a board composed of silicon to secure the heat storage performance.

On the other hand, to avoid an excessive rise of the temperature of the liquid discharge head, excessive heat excluding a heat necessary for the above-described heat storage operation must be released out of the liquid discharge head appropriately. Japanese Patent Application Laid-Open No. 2002-11882 discusses a liquid discharge head capable of releasing such excessive heat by extending a cavitation-resistant metal layer provided on the energy generating element to transfer part of the heat generated by the energy generating element. As described above, the liquid discharge head is provided to release the excessive heat while maintaining the heat storage performance to achieve an effective recording operation.

When the recording operation is executed continuously using the liquid discharge head substrate containing an energy generating element row (hereinafter element row), the temperature of the substrate rises due to a heat generated by the energy generating elements. In this case, heat can be released more easily to a non-heat generation region outside of the element row at nearer an end portion of the element row than at the central portion thereof. Accordingly, a difference in temperature occurs between near the end portion and the central portion of the element row in the liquid discharge head substrate. According to the method discussed in Japanese Patent Application Laid-Open No. 2002-11882, the heat dissipation metal layer is formed to meet each of the energy generating elements equally, so that the difference in temperature cannot be eliminated.

With the difference in temperature generated in the head substrate, a difference occurs also in viscosity of the liquid to be discharged, between at the central portion and the end portion of the element row. As a result, dispersion occurs in the amount of liquid droplet ejected from discharge ports, and therefore, there exists a fear that the quality of recorded images may be deteriorated.

SUMMARY OF THE INVENTION

According to an aspect of the present invention, there is provided a liquid discharge head comprising: a liquid discharge head substrate including an element row in which a plurality of energy generating elements for generating thermal energy for use in discharging liquid are arranged; a discharge port member corresponding to each of the plurality of energy generating elements, the discharge port member including a plurality of walls in contact with the liquid discharge head substrate to form a plurality of liquid chambers for storing liquid and a plurality of discharge ports which communicate with each of the plurality of the liquid chambers to discharge liquid with the thermal energy generated by the energy generating element; and a plurality of heat dissipating members corresponding to each of the plurality of the liquid chambers and having a first portion exposed to the liquid chamber and a second portion exposed to the atmosphere.

According to the present invention, dispersion of the discharging amount of liquid droplet can be suppressed by providing the liquid discharge head with the energy generating elements as described above. As a result, the present invention can provide a highly-reliable liquid discharge head capable of obtaining high-quality recording images.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A liquid discharge head may be installed on a printer, copying machine and a facsimile accommodating communication system, a word processor with a printer unit and industrial recording apparatuses combined with a variety of processing units in a composite manner. Using this liquid discharge head enables recording on various recording media such as paper, thread, fiber, cloth, leather, metal, plastic, glass, wood, and ceramics.

A term "recording" used in this specification means not only attaching an image having a meaning such as character and graphics, but also attaching an image having no meaning such as a pattern.

Another term "liquid" should be interpreted widely and refers to a liquid which is discharged to a recording medium and used for formation of images, decoration and pattern, processing of a recording medium and treatment of ink or the recording medium. The treatment of ink or recording medium expressed here refers to treatment for improvement of the fixing property of ink discharged to a recording medium utilizing coagulation or insolubilization of coloring material contained in ink, improvement of recording quality or coloring property or improvement of image durability.

Figure 1A:
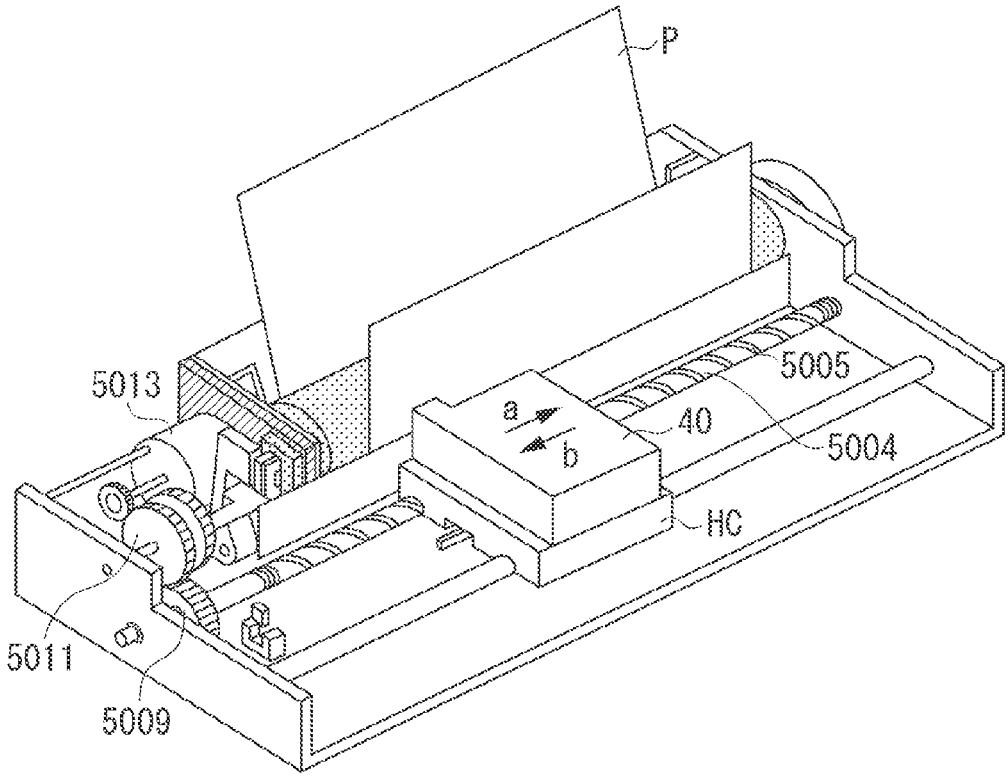
FIGS. 1A and 1B are perspective views of a liquid discharge apparatus and head unit of the present invention.

The liquid discharge apparatus will be described here. FIG. 1A is a schematic view of the liquid discharge apparatus capable of mounting the liquid discharge head of the present invention.

As shown in FIG. 1A, a lead screw 5004 is rotated by driving force transmitting gears 5011, 5009 interlocked with normal/reverse rotations of a driving motor 5013. A carriage HC can be loaded with a head unit and has a pin (not shown) which engages a spiral groove 5005 in the lead screw 5004, so that when the lead screw 5004 is rotated, the carriage HC reciprocates in the directions of an arrow a and an arrow b. This carriage HC is loaded with a head unit 40.

Figure 1B:
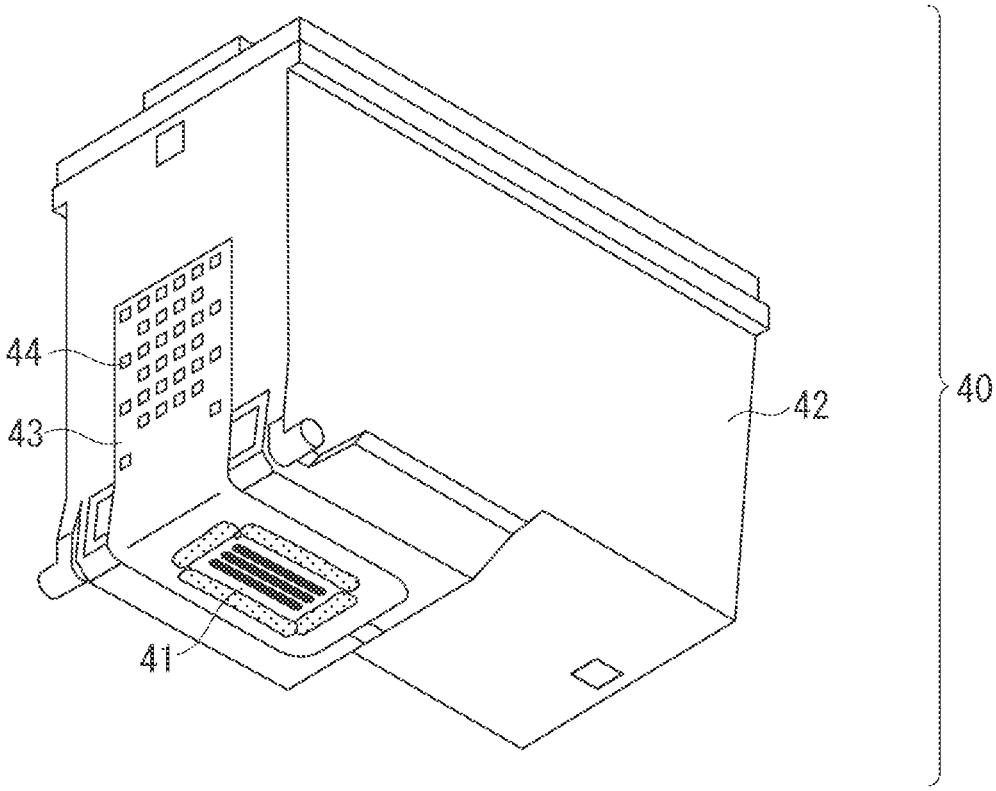

Next, the head unit will be described. FIG. 1B is a perspective view showing an example of the head unit 40 which can be mounted on the liquid discharge unit as shown in FIG. 1A. A liquid discharge head 41 (hereinafter referred to as head depending on the context) is conductive with a contact pad 44, which is connected to the liquid discharge apparatus, via a flexible circuit board 43. The head 41 is joined to an ink tank 42 so that they are integrated to configure the head unit 40. Although the head unit 40 exemplified here is a type in which the ink tank 42 and the head 41 are integrated, the ink tank may be separated to form a detachable type.

Figure 2A:
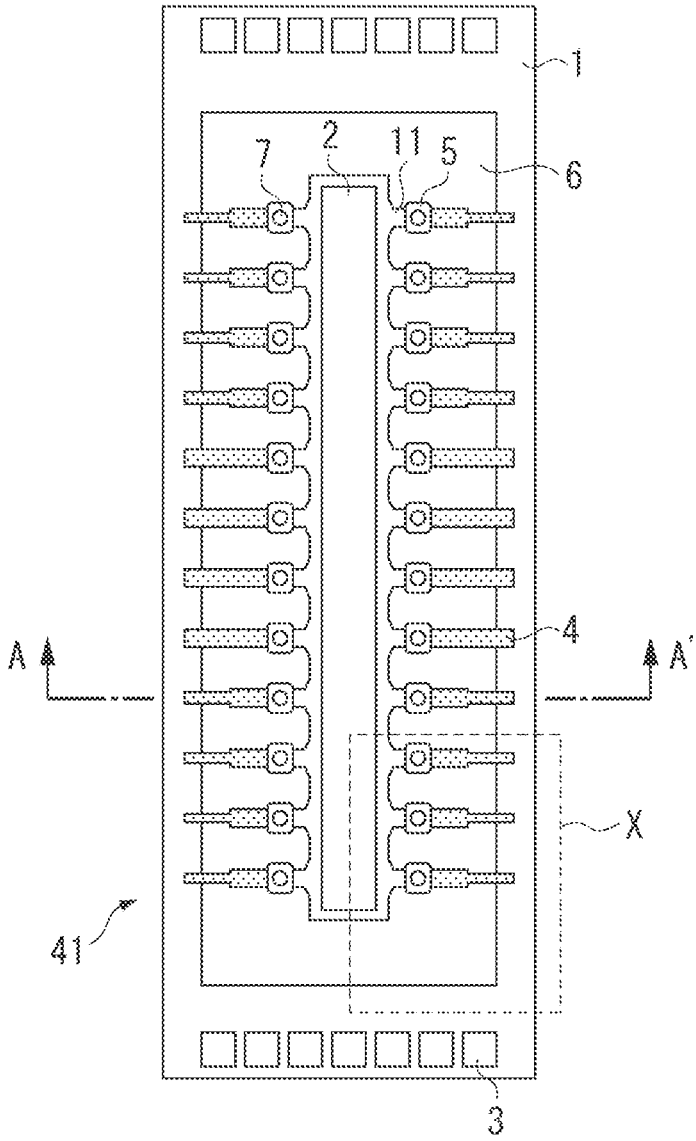
FIGS. 2A, 2B and 2C are a top schematic view, a perspective view and a sectional schematic view of a liquid discharge head of the present invention.
Figure 2B:
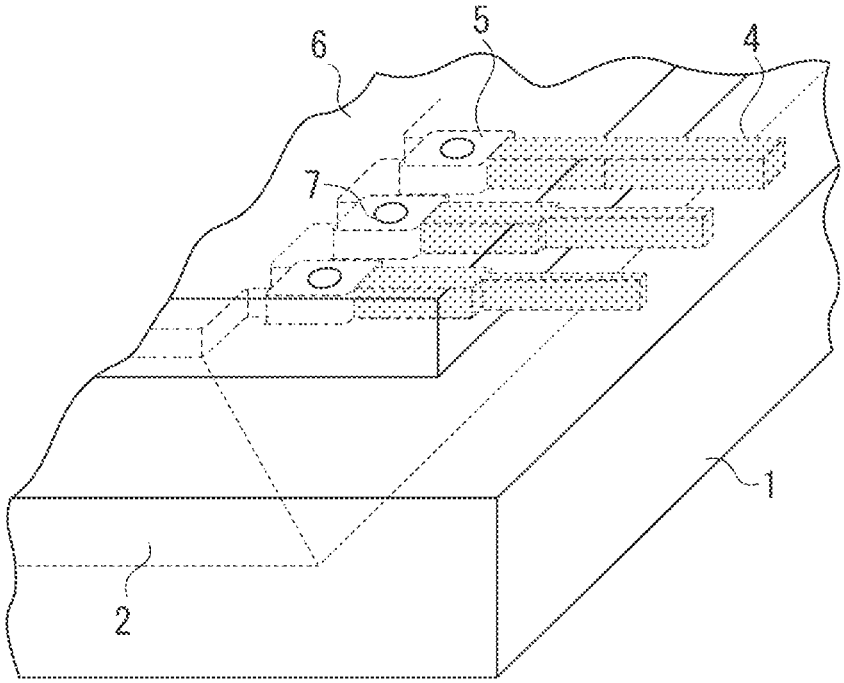
Figure 2C:
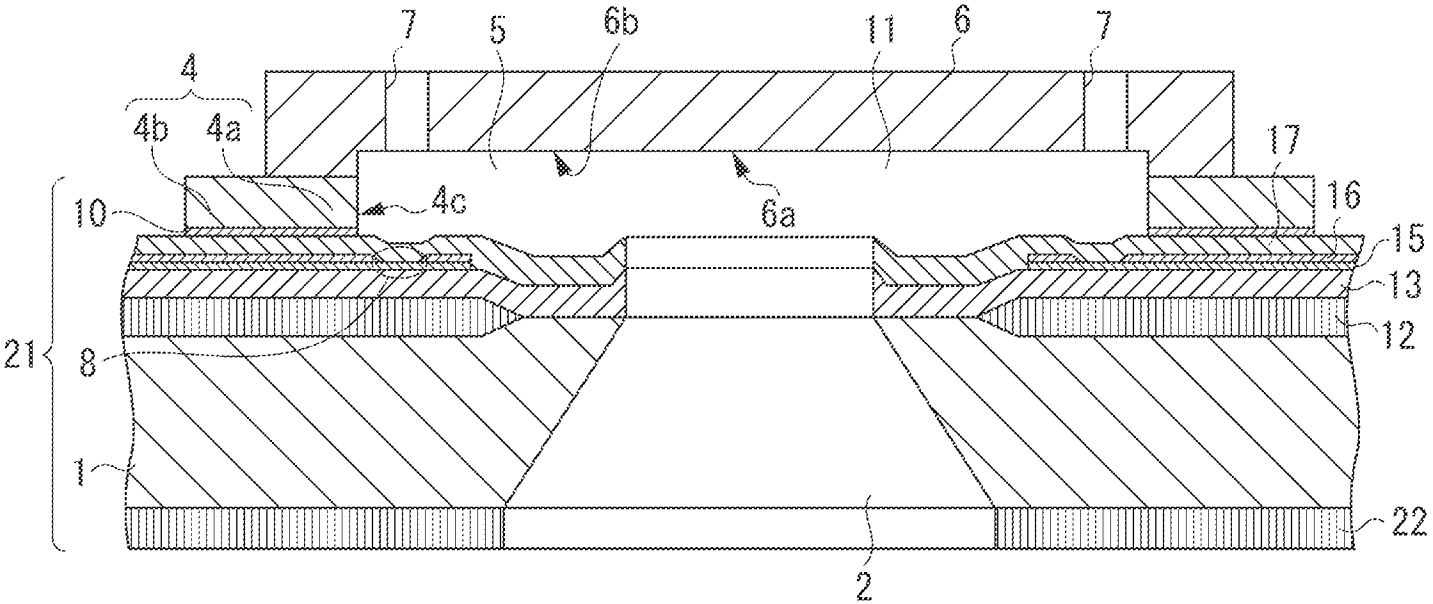

Next, the liquid discharge head will be described. FIG. 2A is a top view of the liquid discharge head 41 of the present invention. FIG. 2B is a magnified perspective view expressing an area X in FIG. 2A. FIG. 2C is a schematic sectional view of the liquid discharge head 41 taken along the line A-A' in FIG. 2A.

The liquid discharge head 41 includes a liquid discharge head substrate 21 and a discharge port member 6. The liquid discharge head substrate 21 has energy generating elements 8 on one side thereof, the energy discharge elements being used for generating thermal energy for discharging liquid. The discharge port member 6 is provided in contact with the liquid discharge head substrate 21. The liquid discharge head substrate 21 is provided with a supply port 2 which passes through a front surface on which the energy generating elements 8 are arranged and a back surface opposite to the front surface to supply liquid. An element row including a plurality of the energy generating elements 8 is arranged on both sides of the supply port 2 such that they run along the supply port 2.

Further, a plurality of terminals 3 are provided at end portions of the liquid discharge head substrate 21 to supply electric signals and electricity for driving the energy generating elements 8 from outside of the liquid discharge apparatus. The energy generating element 8 is constituted of a heat generation resistive layer 15 for generating heat by energization and a pair of electrodes 16 for supplying electricity to the heat generation resistive layer and composed of mainly conductive material such as aluminum. The energy generating element 8 is provided on the board 1 made of silicon via thermal oxide layer 12 composed of silicon and heat storage layer 13.

The energy generating element 8 is covered with protective layer 17 made of silicon nitride (SiN) for protecting from ink. It is permissible to provide cavitation resistive layer 18 made of tantalum or the like for relaxing a shock by cavitation generated when bubbles disappear, on the protective layer 17 to cover the energy generating element 8.

The discharge port member 6 has discharge ports 7 for discharging liquid using energy generated by the energy generating element 8 at positions opposed to each energy generating element 8. The discharge port member 6 further includes a wall 6*a* which acts as a flow path 11 communicating the discharge port 7 with the supply port 2, and a wall 6*b* which acts as a liquid chamber 5 for storing liquid to be discharged temporarily. The discharge port member 6 and the liquid discharge head substrate 21 are kept in contact with each other to form the flow path 11 and the liquid chamber 5. Liquid is supplied from the supply port 2 and carried into the liquid chamber 5 via the flow path 11 and then electricity is turned on between the pair of the electrodes 16. As a result, the energy generating element 8 generates heat to induce film boiling of the liquid. By a bubble pressure generated thereby, liquid droplets are discharged to a recording medium from the discharge port 7 to achieve the recording operation.

The liquid discharge head substrate 21 includes a plurality of heat dissipating members 4 corresponding to each liquid chamber 5. Part of the heat dissipating member 4 is covered with the discharge port member 6 to form a first portion 4*a* which is not exposed to the atmosphere. The first portion 4*a* of the heat dissipating member 4 has a surface 4*c* exposed to the liquid chamber 5. When the flow path 11 and the liquid chamber 5 are filled with liquid, the surface 4*c* contacts this liquid. The heat dissipating member 4 further includes a second portion 4*b* above which the discharge port member 6 is not located and which is exposed to the atmosphere. The surface 4*c* exposed to the liquid chamber 5 and the second portion 4*b* exposed to the atmosphere enable heat absorbed from ink in the liquid chamber 5 to be released into the atmosphere. The larger the surface area of the second portion 4*b* exposed to the atmosphere, the more easily heat is released.

Next, a temperature distribution in the substrate will be described. When the liquid discharge head 41 having an element row including the plurality of the energy generating elements 8 arranged in row performs recording operation through high-speed printing operation continuously, the central and neighboring portions of the element row release heat less effectively than the end portions of the element row, because the area of a non-heat generating region around the central portion is smaller than the end portions. More specifically, although heat generated near the end portion of the element row can escape to the end of the board 1, the central and neighboring portions cannot achieve releasing of heat via the board 1, because the supply port 2 exists. Therefor, a difference in temperature occurs in the liquid discharge head 41.

This temperature difference becomes considerable when a large number of the elements are provided and the element row is long. Further, when a plurality of the supply ports 2 is provided on the liquid discharge head 41, this phenomenon becomes more considerable near the central portion. When the difference in temperature occurs within the liquid discharge head 41, the amount of discharged liquid droplet cannot be equalized even if the amount of energy generated by the energy generating element 8 or the diameter of the discharge port 7 is equal. This may cause occurrence of unevenness of a recorded material. This is considered to originate from a change in the viscosity of ink due to temperature changes. Near the central portion of the element row, the temperature of ink rises with a rise of the temperature of the substrate to decrease the viscosity of ink, so that the size of bubbles increases. On the other hand, at the end portion of the element row, the substrate temperature does not rise so easily and the viscosity of ink does not drop, and consequently, the size of the air bubble becomes relatively small. Therefore, it is considered that the amount of liquid droplet discharged from the end portion of the element row, from which heat escapes easily, is smaller than near the central portion of the element row from which heat escapes less easily.

This phenomenon begins to appear when the length of the element row exceeds approximately 10 mm and is recognized considerably when it exceeds approximately 15 mm. When executing a 50%-duty recording operation using a conventional liquid discharge head 41 including 640 energy generating elements 8 arranged without any heat dissipating member 4, a temperature difference of approximately 10° C. occurs between the energy generating element 8 located at the end portion of the element row and the energy generating element 8 located at the central portion. In this case, the 50%-duty recording operation refers to an operation of discharging ink from 320 nozzles which is ½ the 640 nozzles when the number of the nozzles arranged in row is 640.

Figure 3A:
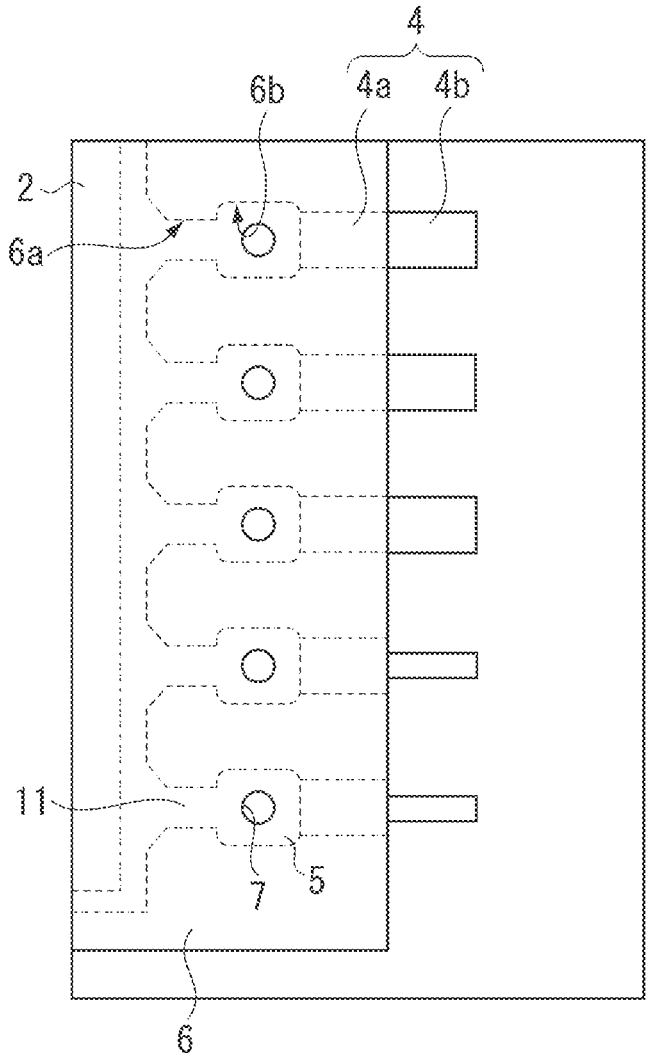
FIGS. 3A, 3B and 3C are top schematic views of the liquid discharge head of the present invention.
Figure 3B:
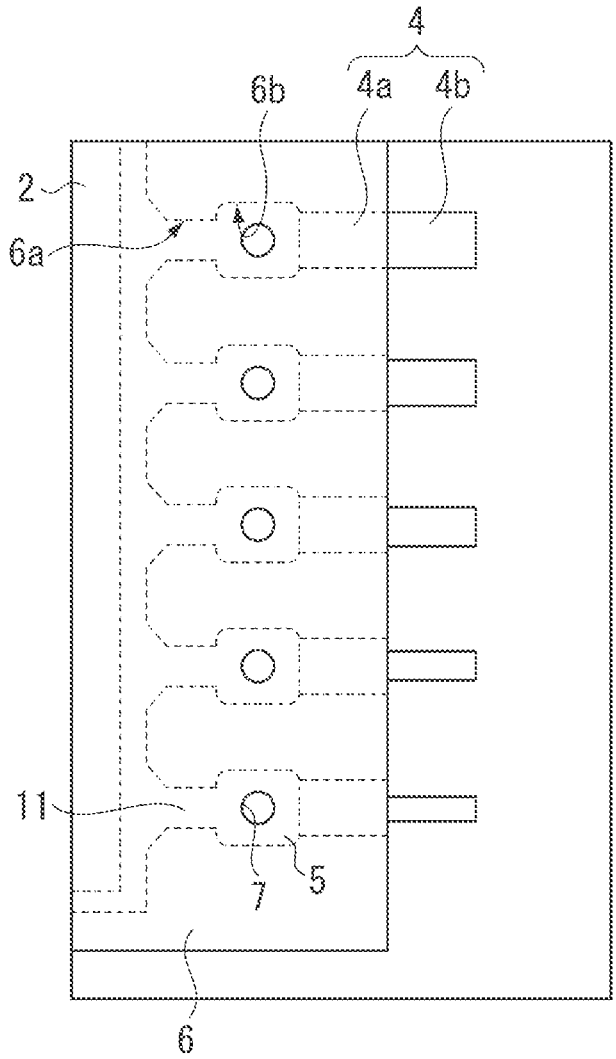
Figure 3C:
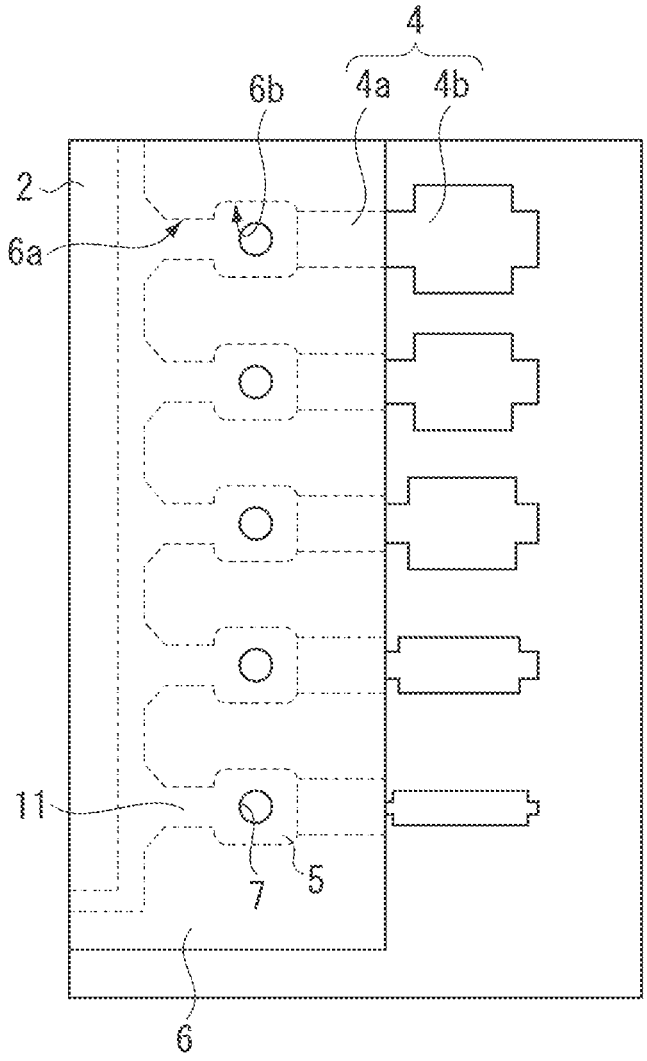

FIGS. 3A, 3B and 3C show an area X in the liquid discharge head 41 shown in FIG. 2A by magnification. The heat dissipating member 4 is provided to release heat of ink to the atmosphere to reduce the temperature difference between the end portion and the central portion of the element row. The second portion 4*b* exposed to the atmosphere, located at the central portion of the heat dissipating member 4 is designed to be larger in its surface area than the second portion 4*b* exposed to the atmosphere located near the end portion of the substrate. An escape of heat to the atmosphere is proportional to the surface area of the element, therefore the heat near the central portion is designed to be released to the atmosphere more easily.

As shown in FIG. 3A, the surface area of the second portion 4*b* corresponding to the energy generating element located near the end portion of the element row may be set smaller. As shown in FIG. 3B, the surface area may be increased gradually from the end portion toward the central portion. As shown in FIG. 3C, the first portion 4*a* may be formed in various shapes. The surface area of the surface 4*c* of the heat dissipating member 4, which is exposed to the liquid chamber 5 and in contact with liquid, is set substantially even in all the liquid chambers. This keeps liquid flow resistance in the liquid chamber 5 even.

As described above, by adjusting the surface area of the second portion 4*b* exposed to the atmosphere of the heat dissipating member 4 appropriately, the temperature difference within the substrate can be reduced. As a result, unevenness in printing quality, which may occur in recording images, can be reduced, whereby leading to realization of a highly-reliable liquid discharge head 41.

The heat dissipating member 4 is preferred to be made of a material having a higher coefficient of thermal conductivity (148 W/(m·k)) than silicon used for the board 1, i.e., a material having a higher coefficient of thermal conductivity than other materials used for the liquid discharge head 41. Further, the heat dissipating member is required not to produce any chemical reaction such as corrosion even if it makes contact with liquid. More specifically, materials may be composed mostly of any one of gold, copper or silver. Each coefficient of thermal conductivity is 320 W/(m·k) for gold, 398 W/(m·k) for copper and 420 W/(m·k) for silver. Gold may be a most useful material since it has an excellent ink resistance.

Figure 4A:
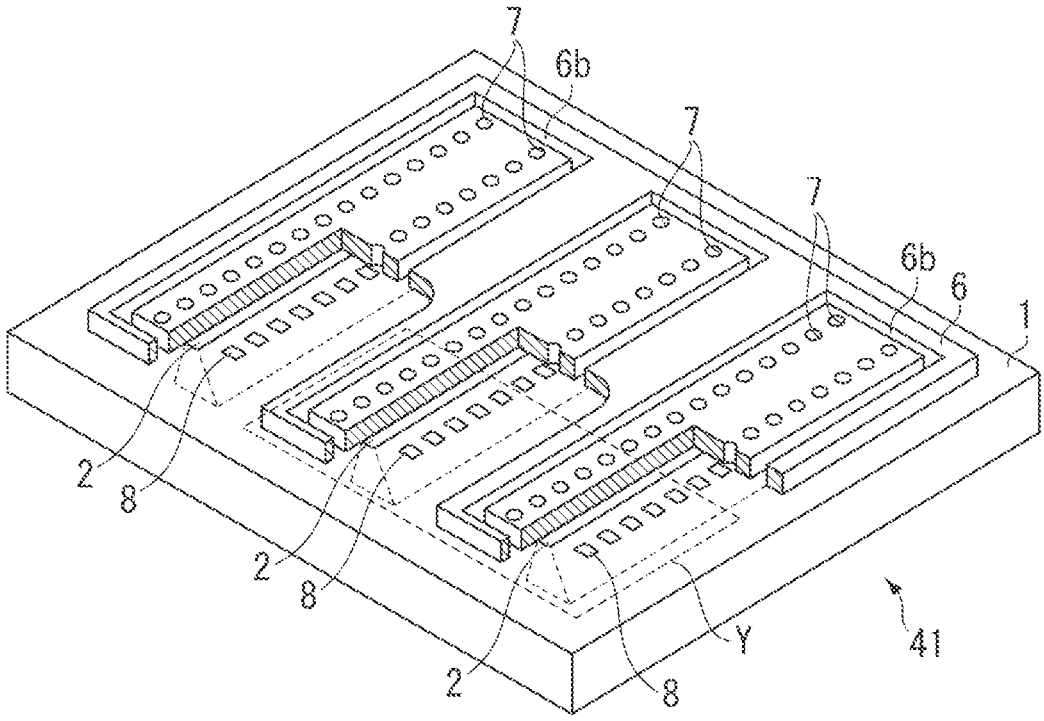
FIGS. 4A and 4B are a perspective view and a top schematic view of the liquid discharge head of the present invention.
Figure 4B:
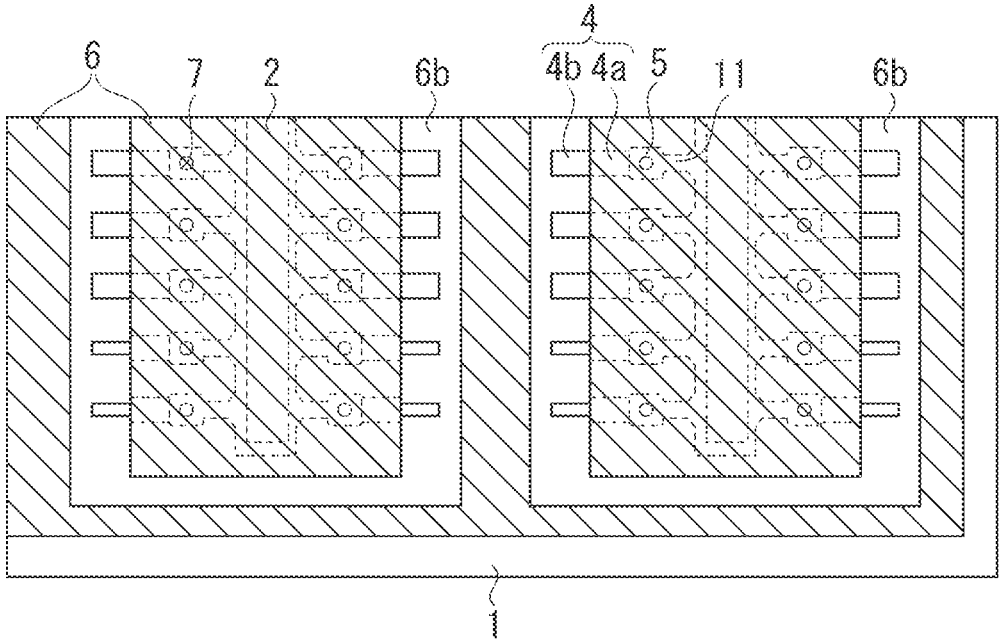

FIG. 4A is a partially broken perspective view of the liquid discharge head 41 in which three supply ports 2 are formed. FIG. 4B is a magnified top view of an areaY in FIG. 4A. When providing a plurality of the supply ports 2, the second portions 4*b* exposed to the atmosphere of a heat dissipating metal may be formed by removing a partial area 6*b* of the discharge port member 6. In this case also, by securing a larger surface area for the second portion 4*b* near the central portion of the element row, in which substrate temperature rises easily, heat can be released from the central portion effectively. In the liquid discharge head provided with a plurality of the supply ports 2, the element row formed along the supply port 2 located at the central portion releases heat less effectively than the element row provided along the supply port 2 at the end portions. Thus, the surface area of the second portion 4*b* corresponding to the energy generating element formed along the supply port 2 located at the central portion is set larger than that of the second portion 4*b* corresponding to the energy generating element along the supply port 2 located on the end portion. As a result, the temperature difference in the element row can be reduced.

Next, a manufacturing method of the liquid discharge head 41 will be described. FIGS. 5A to 5D are schematic sectional views showing a section of the liquid discharge head 41 in each step when cut perpendicularly to the substrate 21 along the line A-A' in FIG. 2A. Here, a case in which gold is used for the material of the heat dissipating member 4 will be described.

First, the board 1 made of silicon is prepared. The board 1 has a front surface provided with the thermal oxide layer 12 for use as a separating layer of a driving device such as a transistor, and a back surface provided with a thermal oxide layer 22 which serves as a mask when forming the supply port 2. A sacrifice layer 25 of approximately 200 nm to 500 nm thick is provided at a portion of the front surface in which the supply port 2 is expected quickly to be bored, by etching with etching solution for use in boring the supply port 2 and applying a conductive material. The sacrifice layer 25 may be formed at a portion corresponding to the supply port 2 by sputtering and dry-etching using a material (e.g., Al—Si alloy) which is composed of mainly aluminum or polysilicon. The heat storage layer 13 is provided on the board 1 having the sacrifice layer 25. The heat storage layer 13 is formed of silicon oxide ($SiO_2$) in a thickness of approximately 500 nm to 1 um according to CVD methods.

Next, a heat generation resistive layer 15 is formed into a layer approximately 10 nm to 50 nm thick by sputtering using a high resistance material composed of TaSiN or WSiN, which generates heat when conducting electricity. Further, a conductive layer is formed of mainly aluminum in the thickness of approximately 100 nm to 1 um by sputtering. The conductive layer serves as a pair of the electrodes 16 for energizing the heat generation resistive layer 15. By processing the heat generation resistive layer 15 and the conductive layer by dry etching and then removing part of the conductive layer by wet etching to form the pair of the electrodes 16. The heat generation resistive layer 15 corresponding to the removed portion is used as the energy generating element 8. Then, the protective layer 17 approximately 100 nm to 1 um thick, having insulation property is formed of mainly silicon nitride (SiN) on the entire surface of the substrate by means of the CVD method. As a result, the heat generation resistive layer 15 and the pair of the electrodes 16 are covered by the protective layer 17. After the processing described above, a status indicated in FIG. 5A is achieved.

Figure 5A:
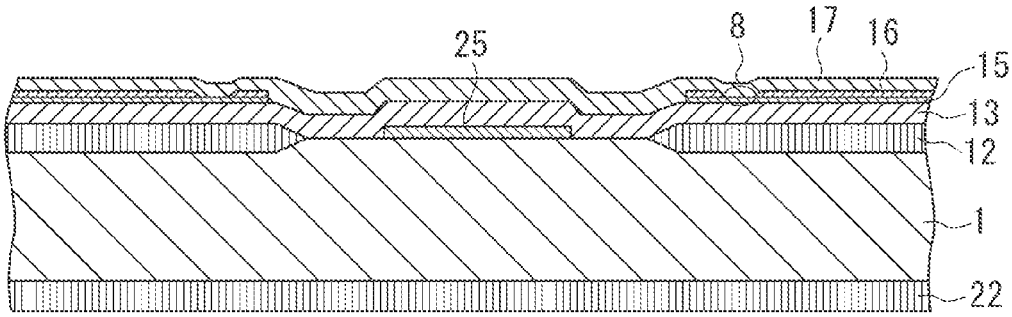
FIGS. 5A, 5B, 5C and 5D are schematic sectional views illustrating a manufacturing method of the liquid discharge head of the present invention.
Figure 5B:
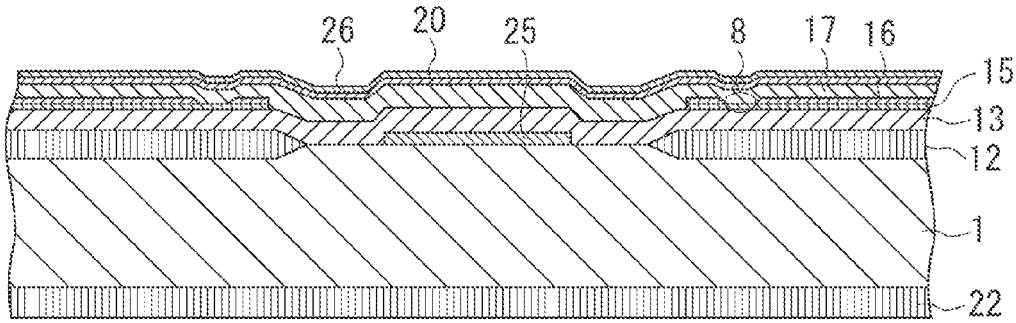

Next, a diffusion preventing layer 20 is formed of high-melting-point metal such as titanium tungsten on the protective layer 17 to prevent diffusion of the material of the heat dissipating member 4. Further, a under coat gold layer 26 for use as a seed layer when forming the heat dissipating member 4 by plating is provided on the diffusion preventing layer 20 by sputtering (FIG. 5B).

A resist pattern 23 having an opening in which the heat dissipating member 4 is to be formed is provided in a larger thickness than that of the heat dissipating member 4 on the under coat gold layer 26. This resist pattern 23 may be formed by coating, exposure to light and development by photolithography. In this case, the openings are made in a shape of the portion 4*b* exposed to the atmosphere of the heat dissipating members 4 as shown in FIGS. 3A to 3C. Specifically, the openings located near the central portion of the element row are larger than the openings near the end portion.

Figure 5C:
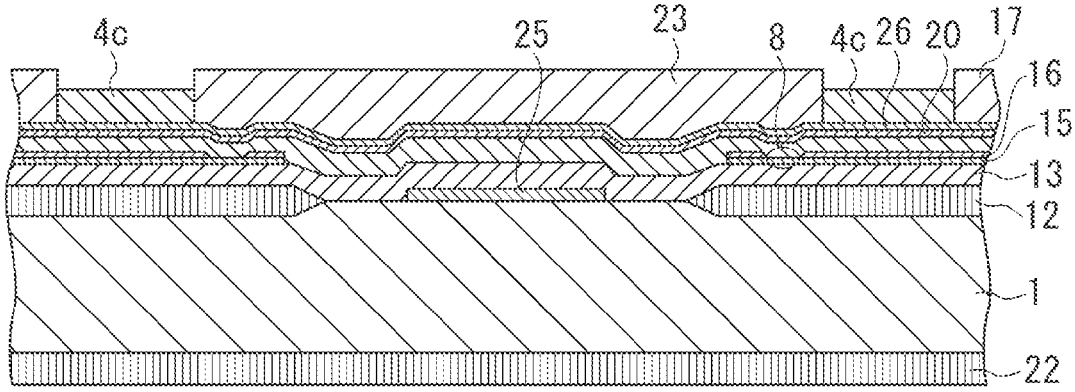

Next, a metal member 4C, which serves as the heat dissipating member 4, is formed using electrolytic plating method. More specifically, current is fed to the under coat gold layer 26 in electrolyte containing nitrite gold salt. As a result, only the opening of the resist pattern 23 is provided with the metal member 4 (FIG. 5C). In this case, the heat dissipating member 4C located at the end portion of the element row is provided with a smaller surface area than the heat dissipating member 4 located near the central portion of the element row.

Figure 5D:
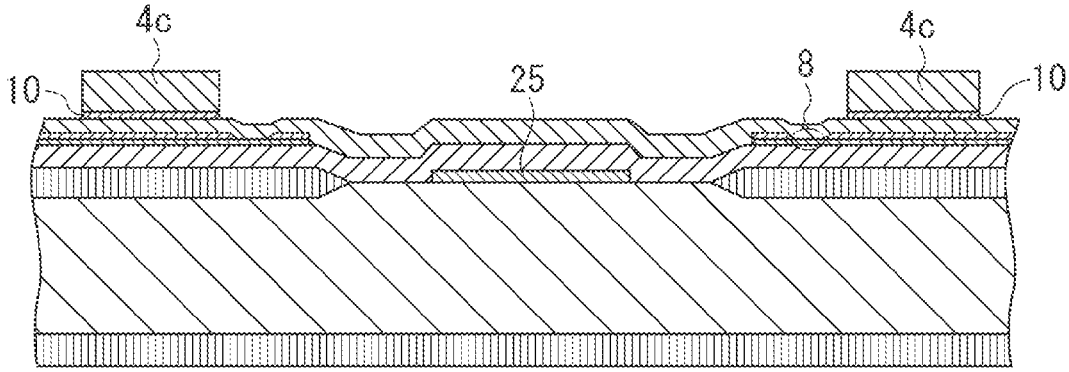

After that, the resist pattern is removed and then, the under coat gold layer 26 is etched with the metal member 4C used as a mask. Although in this case, the surface of the metal member 4C is etched, the metal member 4C is left on the substrate because its thickness is much larger than the under coat gold layer 26. Further, the diffusion preventing layer 20 is etched with the metal member 4 used as a mask and removed (FIG. 5D). In the above-described manner, the liquid discharge head substrate 21 is completed. At the same time when the metal member 4C is formed, the terminals 3 for receiving electric signals from outside of the liquid discharge apparatus are formed by electrolytic plating method. Consequently, the heat dissipating members 4 and the terminals 3 can be provided by forming them at the same time without increasing the number of manufacturing processes.

Soluble resin is formed on the surface of the liquid discharge head substrate 21 by spin-coat method, and a mold material (not shown) is formed at a section where the flow path 11 and the liquid chamber 5 are to be formed by photolithography technology. In this case, the mold material is provided such that it keeps contact with the surface 4*c* which faces the liquid chamber 5 of the metal member 4C. As a result, the surface 4*c* is exposed to the liquid chamber 5 so that the surface 4*c* makes contact with liquid. The surfaces 4*c* of the plurality of metal members 4C is provided to have substantially the same area exposed to the liquid chamber 5.

As the discharge port member material, cationic polymerization epoxy resin is applied onto the mold material by the spin-coat method and the cationic polymerization epoxy resin is baked and cured using a hot plate to form cured material, which serve as the discharge port member 6. The cured material is removed partly from sections corresponding to the discharge port 7 and the second portion 4*b* exposed to the atmosphere of the heat dissipating member 4 by photo-lithography technology. As a result, the discharge port member 6 is formed. In this case, the second portion 4*b* corresponding to the energy generating element 8 located near the central portion of the element row is formed with a larger surface area than the second portion 4*b* corresponding to the energy generating element 8 located at the end portion of the element row.

The discharge port member 6 is protected with cyclized rubber layer, and the thermal oxide layer 22 is made opening and used as a mask for forming the supply port 2.

After that, using tetramethylammonium hydroxide solution (TMAH solution) or potassium hydroxide aqueous solution (KOH solution), the back surface of the board 1 is wet-etched to form a through hole for use as the supply port 2. Then, the sacrifice layer 25 is removed. By using a silicon single crystal substrate whose surface crystal orientation is (100) face as the board 1, the supply port 2 is made by crystal anisotropy etching using alkali solution (e.g., TAMH solution or KOH solution). In such a board 1, the etching rate of the (111) face is much slower than that of other crystal faces, so that the supply port 2 angled at approximately 54.7° with respect to the silicon substrate plane is formed. After that, the cyclized rubber layer and the mold material are removed to complete the liquid discharge head 41 having the heat dissipating member 4, which has the surface 4*c* exposed to the liquid chamber 5 (FIG. 2C). Furthermore, although the method for forming the supply port by wet-etching method is described above, it is possible to apply the dry etching method for the same purpose.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-219482 filed Sep. 29, 2010, which is hereby incorporated by reference herein in its entirety.

What is claimed is:

1. A liquid discharge head comprising:

a liquid discharge head substrate including an element row in which a plurality of energy generating elements for generating thermal energy for use in discharging liquid are arranged;

a discharge port member including a plurality of walls in contact with the liquid discharge head substrate to form a plurality of liquid chambers for storing liquid and a plurality of discharge ports which communicate with each of the plurality of the liquid chambers to discharge liquid with the thermal energy generated by the energy generating element; and a plurality of heat dissipating members, a single heat dissipating member corresponding to each of the plurality of the liquid chambers and having a first portion exposed to the liquid chamber and a second portion having a surface area exposed to the atmosphere, wherein the surface area of the second portion of at least two heat dissipating members of the plurality of heat dissipating members are not equal in area.

2. The liquid discharge head according to claim 1, wherein, of the plurality of the heat dissipating members, the surface area of the second portion of a first heat dissipating member corresponding to a central portion of the element row is greater than the surface area of the second portion of a second dissipating member corresponding to a side nearer an end portion of the element row than the first heat dissipating member.

3. The liquid discharge head according to claim 1, wherein a thermal conductivity of a material constituting the heat dissipating member is higher than any one of a thermal conductivity of a material constituting the discharge port member and a thermal conductivity of a material constituting the liquid discharge head substrate.

4. The liquid discharge head according to claim 1, wherein the heat dissipating member is composed mostly of any one of gold, copper or silver.

5. The liquid discharge head according to claim 1, wherein the surface area of the second portion of the heat dissipating members is increased gradually from an end portion of the element row toward a central portion of the element row.

6. The liquid discharge head according to claim 1, wherein the liquid discharge head substrate includes terminals for electrical connection with outside of the liquid discharge head substrate to drive the energy generating element, the terminals being formed of the same material as the heat dissipating member.

7. The liquid discharge head according to claim 1, wherein a surface area of each of the plurality of the first portion is substantially equivalent.

8. A liquid discharge head comprising:

a liquid discharge head substrate including an element row in which a plurality of energy generating elements for generating thermal energy for use in discharging liquid are arranged;

a discharge port member including a plurality of walls in contact with the liquid discharge head substrate to form a plurality of liquid chambers for storing liquid and a plurality of discharge ports which communicate with each of the plurality of the liquid chambers to discharge liquid with the thermal energy generated by the energy generating element;

at least one first heat dissipating member corresponding to a first liquid chamber of the plurality of liquid chambers and having a first portion exposed to the first liquid chamber and a second portion having a surface area exposed to the atmosphere; and at least one second heat dissipating member corresponding to a second liquid chamber of the plurality of liquid chambers and having a first portion exposed to the second liquid chamber and a second portion having a surface area exposed to the atmosphere, wherein a total area of the surface area of the second portion of the at least one first heat dissipating member and a total area of the surface area of the second portion of the at least one second heat dissipating member are not equal.

9. The liquid discharge head according to claim 8, wherein the second liquid chamber is positioned on a side nearer an end portion of the element row than the first liquid chamber, and wherein the total area of the surface area of the second portion of the at least one first dissipating member is greater than the total area of the surface area of the second portion of the at least one second dissipating member.

10. The liquid discharge head according to claim 8, wherein a thermal conductivity of a material constituting the first heat dissipating member and the second dissipating member is higher than any one of a thermal conductivity of a material constituting the discharge port member and a thermal conductivity of a material constituting the liquid discharge head substrate.

11. The liquid discharge head according to claim 8, wherein the first heat dissipating member and the second heat dissipating member are composed mostly of any one of gold, copper or silver.

* * * * *